United States Patent [19]

Riegel et al.

[11] Patent Number: 4,828,570

[45] Date of Patent: May 9, 1989

[54] TANNING AGENT AND A PROCESS FOR ITS PREPARATION

[75] Inventors: Ulrich Riegel; Fritz Engelhardt; Kuno Reh; Helmut Croon, all of Frankfurt am Main; Hermann Becker, Jügesheim; Werner Lotz, Niedernhausen, all of Fed. Rep. of Germany

[73] Assignee: Cassella Aktiengesellschaft, Frankfurt am Main, Fed. Rep. of Germany

[21] Appl. No.: 917,600

[22] Filed: Oct. 9, 1986

[30] Foreign Application Priority Data

Nov. 13, 1985 [DE] Fed. Rep. of Germany ..... 3540211

[51] Int. Cl.[4] ..... C14C 3/00

[52] U.S. Cl. ..... 8/94.19 R; 8/94.21; 8/94.24; 528/69; 528/128; 528/266

[58] Field of Search ..... 528/266, 128, 69; 8/94.19 R, 94.19 C, 94.24

[56] References Cited

U.S. PATENT DOCUMENTS 3,991,328 11/1976 Topfl et al. ..... 427/386

*Primary Examiner*—A. Lionel Clingman
*Assistant Examiner*—John F. McNally
*Attorney, Agent, or Firm*—Connolly and Hutz

[57] ABSTRACT

Hides, skins and pelts are tanned by use of a tanning agent which comprises the reaction product of acetaldehyde, formaldehyde and a formylamino compound.

17 Claims, No Drawings

TANNING AGENT AND A PROCESS FOR ITS PREPARATION

The use of trimethylolacetaldehyde for tanning hides, skins and pelts is known from German Patent Specification No. 1,154,593 and the associated German Patent of Addition. The trimethylolacetaldehyde can be used here by itself or in combination with other known mineral, synthetic or vegetable tanning agents. Soft leather with a supple grain is obtained when hides and skins are tanned with trimethylolacetaldehyde. Pelts tanned using trimethylolacetaldehyde are distinguished, for example, by softness and a particularly light weight.

It has now been found that the results which can be achieved with trimethylolacetaldehyde in the tanning of hides, skins and pelts, by itself of in combination with other tanning agents, can be further improved by using the tanning agents according to the invention.

The tanning agents according to the invention is obtained by reacting acetaldehyde, formaldehyde and a formylamino compound, in particular in a molar ratio of acetaldehyde : formaldehyde : formylamino compound = 1: (0.4 to 4) : (0.1–3), preferably 1: (0.5 to 3.1) : (0.2 to 2.2), and very especially preferably 1: (0.5 to 3) : (0.2 to 2). The reaction is preferably carried out under alkaline catalysis.

The formylamino compound can contain one, two or more formylamino groups of the formula I

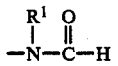

(I)

wherein $R^1$ denotes hydrogen or $—CH_2OH$. $R^1$ is preferably hydrogen. Suitable formylamino compounds with one or two formylamino groups in the molecule have, for example, the formula II

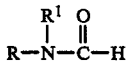

(II)

wherein $R^1$ has the meaning already given and R denotes hydrogen, $(C_1–C_8)$alkyl, $(C_2–C_8)$alkenyl, $—(CH_2)_m—N(R^1)—CHO$ or $—O—(CH_2)_n—O—N(R^1)—CHO$, wherein m is an integer from 0 to 8 and n is an integer from 1 to 8.

The alkyl and alkenyl radicals represented by R can be straight-chain or branched. $(C_1–C_6)$alkyl radicals are preferred in the case of the alkyl radicals represented by R, and $(C_2–C_6)$alkenyl radicals are preferred in the case of the alkenyl radicals represented by R. The vinyl radical is particularly preferred in the case of the alkenyl radicals represented by R.

The number m denotes, in particular, 0 or 1, and the number n denotes, in particular, 1.

Suitable formylamino compounds can also contain 3 or more formylamino groups of the formula I in the molecule. Formylamino compounds of the type mentioned are known or can be synthesized by the processes known for the preparation of formylamino compounds. Examples of suitable formylamino compounds are: formamide; methyl-, ethyl-, propyl-, i-propyl-, butyl-, i-butyl-, sec.-butyl-, pentyl- or i-pentyl-formamide; vinyl-, allyl-, methallylor crotyl-formamide; N-hydroxymethyl-N-methyl-, -ethyl- or propylformamide; N,N'-bis-formyl-hydrazine; methylene-bis-formamide; methylene-bis-(N-hydroxymethyl-formamide); ethylene-bis-formamide; trimethylene-bis-formamide; tetramethylene-bis-formamide; methylene-bis-(O-formhydroxamic acid) $((H—CO—NH—O)_2CH_2)$ and ethylene-bis-(O-formhydroxamic acid) $(H—CO—NH—O—CH_2CH_2—ONH—CO—H)$.

Formylamino compounds which are suitable as the starting substance for the preparation of the tanning agent according to the invention are moreover also homo- or copolymers which contain units of the formula III

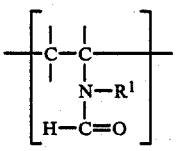

(III)

in the polymer. Such polymers are, for example, homopolymers of vinylformamide, and furthermore copolymers of vinylformamide with, for example, acrylic acid, methacrylic acid, unsaturated sulphonic acids, such as, for example, vinylsulphonic acid, acrylamido propanesulphonic acid, unsaturated phosphonic acids, such as, for example, vinylphosphonic acid, and esters of unsaturated phosphonic acids, diallyldimethylammonium chloride, vinylamides, such as, for example, vinylacetamide, and acrylonitrile. Such homoor copolymers are water-soluble and have an average molecular weight of about 5,000 to 500,000.

In the preparation of the tanning agents according to the invention, a formylamino compound or a mixture of various formylamino compounds can be employed, in addition to the acetaldehyde and formaldehyde. The reaction is as a rule carried out in an aqueous phase, preferably under alkaline catalysis. An alkalizing agent is added for the alkaline catalysis. Examples of suitable alkalizing agents are alkali metal hydroxides, such as, for example, sodium hydroxide, potassium hydroxide or lithium hydroxide, alkaline salts, such as, for example, alkali metal carbonates, such as, for example, sodium carbonate, potassium carbonate or lithium carbonate, or tertiary nitrogen bases, such as, for example, pyridine. Sodium carbonate is as a rule used as the alkalizing agent. 0.008 to 0.3 mol, preferably 0.01 to 0.2 mol, of the alkalizing agent is usually employed per mol of acetaldehyde.

The reaction can be carried out batchwise or continuously and is highly exothermic. In the case of a batchwise procedure for the reaction, it is advisable to take one or two of the reaction partners in the aqueous phase, with cooling (for example to +10° C.), and to add the remaining reaction component or the remaining reaction components and the alkalizing agent, after which the reaction starts immediately, with an increase in temperature. In the case of the batchwise procedure for the reaction it is usually also advisable not to add the entire amount of the reaction partners to the reaction all at once, but to divide them into two or more part amounts and to add the remaining part amounts only when the reaction has subsided. The reaction temperatures are in general between 0° and 140° C., preferably 5° and 130° C. In the case of the batchwise procedure for the reaction, the first phase of the reaction is frequently carried out with cooling, at reaction temperatures of up to about 60° to 70° C. and, when the evolution of heat has subsided, the reaction is brought to completion at an elevated temperature of, for example, 60° C. or more.

In the case of temperatures above the boiling point of the reaction mixture under normal pressure, the reaction is carried out in a pressure reactor under the autogenous increased pressure of, for example, 4 to 6 bar. Carrying out the reaction at temperatures above 100° C., for example 100° to 140° C., in particular 100° to 130° C., makes short reaction times possible, which means that the exposure of the products prepared to heat can be reduced substantially. This also particularly applies in the case of a continuous procedure for the reaction, which is preferred.

Formaldehyde is as a rule used in the form of the commercially available aqueous solutions, for example 39% strength aqueous solutions.

The solution obtained when the reaction has ended, which usually has an active compound content of about 30 to about 70% by weight, is advantageously filtered and brought to a neutral or approximately neutral pH with an alkalizing agent, for example of the type already mentioned. The liquid products thus obtained are clear or approximately clear and have a slightly yellowish to brownish colour. They can be stored for at least two years under normal conditions and can be diluted with water in all proportions. They solidify at temperatures below about −10° C., but are entirely usuable again after careful thawing.

The products according to the invention, which can be assumed to contain a mixture of different reaction products, are outstandingly suitable as such or in the form of their aqueous solutions as tanning agents for hides, skins and pelts, and in particular by themselves or in combination with mineral, vegetable or other synthetic tanning agents. They also have an excellent compatibility with dyestuffs and fat liquoring agents in the various stages of leather and pelt production. In comparison with the use of timethylolacetaldehyde, the elasticity, fullness and softness are clearly improved. The shrinkage temperature is also increased and the grain strength is improved. In leather dyeing, inadequate penetration dyeings can be eliminated with the aid of the products according to the invention. In fat liquoring of leather, the softening effect of the fat liquoring agents is increased and the risk of looseness of the grain is reduced by addition of the products according to the invention. Since the products according to the invention have a favourable influence on the pliability and softness of the leather, they are particularly suitable for the production of soft glove leather and napa clothing leather. The products according to the invention have a tanning action in the pH range from 2 to 9.

In the following examples, temperatures are in °C. and percentages, unless mentioned otherwise, are given as percentages by weight.

Examples 1 to 16 relate to the preparation of products according to the invention by the process according to the invention, and Examples 17 to 23 relate to the use of the products according to the invention in tanning. The 39% strength formaldehyde mentioned in Examples 1 to 4 is a commercially available aqueous solution with a formaldehyde content of 39%.

EXAMPLE 1

Preparation of a reaction product of acetaldehyde, formaldehyde and formamide in a molar ratio of 1:2.68:0.46.

50 g of drinking water, 440 g of 39% strength formaldehyde and 58.5 g of formamide are taken, with stirring, in a 1 l reaction flask equipped with a stirrer, thermometer and reflux condenser, and are cooled to 10° C. by means of a cooling bath. 125 g of acetaldehyde and a solution of 1.1 g of sodium carbonate in 16 g of drinking water are then added in succession, in each case in one portion.

The reaction starts immediately, the temperature rising up to about 60° C. in the course of 10 minutes. When the temperature drops by itself, the solution is cooled down to 30° C. A further 145 g of 39% strength formaldehyde and 6.5 g of sodium carbonate are then added in one portion. The temperature then rises again up to about 40° C. in the course of about 20 minutes. When the temperature drops again, the solution is heated and subsequently stirred for in each case 1 hour at 60° C., 70° C. and 80° C. and is then cooled to room temperature and brought to a pH of 7.0±0.5 with sodium carbonate. The mixture is filtered. A virtually clear, yellowish-coloured solution is obtained.

EXAMPLE 2

Preparation of a reaction product of acetaldehyde, formaldehyde and bis-formyl-hydrazine in a molar ratio of 1:3:0.1.

The following are added in succession via a pressure burette to a pressure reactor at room temperature, with stirring: 655 g of 39% strength formaldehyde, 25 g of bis-formyl-hydrazine, 125 g of acetaldehyde and 80 g of 10% strength aqueous sodium carbonate solution.

The reaction starts immediately and the temperature rises up to about 55 to 60° C. in the course of a few minutes, a pressure of 0.9 to 1.1 bar building up. The solution is now heated to 105 to 110° C., whereupon a pressure of 4.5 to 5 bar is established, and is kept at this temperature for 5 to 10 minutes. It is then cooled again to room temperature. Filtration gives an almost clear ready-to-use solution yellowish-brown in colour, which is subsequently adjusted, if appropriate, to a pH of 7.0 +0.5 with sodium carbonate.

EXAMPLE 3

Preparation of a reaction product of acetaldehyde, formaldehyde and formamide in a molar ratio of 1:1:2.

1 mol of acetaldehyde, 1 mol of 39% strength formaldehyde and 2 mol of formamide, continuously by metering pumps, and small amounts of 10% strength aqueous sodium carbonate solution are fed from the bottom into a pressure vessel equipped with a stirrer, the acetaldehyde, formaldehyde and formamide bieng premixed in the feed system. The reaction temperature in the pressure vessel is 110° to 115° C. under a pressure of 4 bar. After an average residence time of 5.5 minutes, the reaction mixture is removed in the upper part of the pressure reactor, cooled to room temperature in a cooling tube and filtered over a filter cartridge. A clear, almost colourless ready-to-use solution, which, if appropriate, is subsequently brought to a pH of 7.0±0.5 with sodium carbonate, is obtained.

EXAMPLE 4

Preparation of a reaction product of acetaldehyde, formaldehyde and formamide in a molar ratio of 1:0.5:2.

50 g of drinking water, 109 g of 39% strength formaldehyde and 255 g of formamide are taken, with stirring, in a 1 l reaction flask equipped with a stirrer, thermometer and reflux condenser and are cooled to 10° C. by means of a cooling bath. 125 g of acetaldehyde are then added all at once and 40 g of a 10% strength aqueous sodium carbonate solution are added dropwise in the course of 5 to 10 minutes. The temperature already rises up to about 25° C. immediately after the addition of acetaldehyde, and after the addition of sodium carbonate a temperature of 35 to 40° C. is reached. After the internal temperature has fallen, the mixture is heated slowly to 70° C. and is subsequently stirred at 70° C. for 1 hour and then at 80° C. for 2 hours, and is then cooled to room temperature and brought to a pH of 7.0±0.5 with sodium carbonate. An almost clear solution yellowish-brown in colour is obtained.

EXAMPLES 5 TO 16

Other products according to the invention are prepared analogously to Examples 1 to 4. The molar ratios and the structure of the formylamino compound are given in Table 1.

TABLE 1

| Example | Molar ratio $CH_3-CHO$ | $H-CHO$ | $R-N(R^1)CHO$ | R | $R^1$ |
|---|---|---|---|---|---|
| 5 | 1 | 1.5 | 1.6 | H— | H— |
| 6 | 1 | 2.68 | 1.5 | H— | H— |
| 7 | 1 | 2.68 | 0.25 | H— | H— |
| 8 | 1 | 2.8 | 0.6 | $H_5C_2$— | H— |
| 9 | 1 | 2.68 | 0.21 | OHCNH— | H— |
| 10 | 1 | 2.68 | 0.45 | OHCNH— | H— |
| 11 | 1 | 3.0 | 0.1 | OHCNH— | H— |
| 12 | 1 | 2.68 | 0.45 | $OHCNHCH_2$— | H— |
| 13 | 1 | 2.0 | 1.0 | $OHCNHOCH_2O$— | H— |
| 14 | 1 | 2.8 | 0.4 | OHCN—$CH_2$— (|) $CH_2OH$ | $HOCH_2$— |
| 15 | 1 | 2.7 | 0.75 | $H_2C=CH$— | H— |
| 16 | 1 | 3 | 0.25 | * | |

*Poly(vinylformamide) with an average molecular weight of about 100,000 is used in Example 16.

EXAMPLE 17

Sheep hides prepared for tanning and pickled in the customary manner are milled with (% based on the pickled weight) 100% of water at 23° C., 3% of salt and 4% of the reaction product prepared according to Example 3 for 60 minutes. The liquor and hides are then brought to a pH value of 6 to 6.5 in the course of 2 hours by addition of sodium carbonate in two to three instalments. 3 to 4% of a cationically emulsified fat liquor with a pure fat content of 80 to 85%, to which 0.3 to 0.5% of a neutral fat (sperm oil or neatsfoot oil) can also be admixed, are then added to the same bath and milling is continued for a further 2 hours. The leather is placed on a buck overnight and is then rinsed briefly and dried at room temperature at 25° C.

After sawdusting and staking, a soft leather which is clearly superior in fullness and handle to a leather tanned in the same way but with trimethylolacetaldehyde is obtained.

EXAMPLE 18

Pickled hides (sheep, goat or peccary) prepared in the customary manner and with a pH of 1.5 to 3.5 are milled with (% based on the pickled hide weight) 150% of water and 3 to 5% of salt (depending on the pH of the pickled hides) for 10 minutes. 4% of the reaction product from Example 3 are then added to the bath and milling is carried out for 30 minutes. 2% of chrome alum (0/12 bas.) or chromium acetate are then added to the bath and milling is carried out for 30 minutes. 3% of a basic aluminium salt in powder form are then added to the bath and milling is carried out for 30 minutes. After addition of 1% of a fat liquoring agent with a fat content of about 70%, milling is carried out for a further 30 minutes, a pH of 4 to 4.5 is then established with 2 to 3% sodium bicarbonate in 3 to 4 instalments in the course of 120 minutes and fat liquoring is then carried out in the same bath with 5% of an anionically emulsified liquoring oil (80 to 85% pure fat content), to which 1% of sperm oil is also added. The leather is then placed on a buck overnight and is subsequently rinsed and finished in the customary manner.

White, very soft glove leather with a good fullness and pliability is obtained.

EXAMPLE 19

Pickled hides (sheep, goat or peccary) prepared in the customary manner and with a pH of 1.5 to 3.5 are milled with (% based on the pickled hide weight) 150% of water and 3 to 5% of salt (depending on the pH of the pickled hides) for 10 minutes. 4% of the reaction product from Example 3 are then added to the bath and milling is carried out for 30 minutes. 4% of a basic aluminium salt is then added to the bath and milling is carried out for a further 60 minutes. The pH of the bath is then buffered by addition of 2 to 3% sodium acetate in 2 to 4 instalments in the course of 120 minutes and, if appropriate, a pH of 4.3 to 4.4 is established by addition of 0.2 to 0.5% sodium bicarbonate. Fat liquoring is then carried out with 3 to 4% of an anionically emulsified liquor oil (about 80% pure fat content) for 90 minutes. The leather is then placed on a buck overnight and is subsequently rinsed and finished in the customary manner.

White glove leather with a good softness, fullness and pliability is obtained.

EXAMPLE 20

Semichrome-tanned or purely chrome-tanned leather milled thoroughly in the customary manner can be prerun with 1.5 to 2% (based on the dry weight) of a product according to the invention (for example according to Example 3) for 15 minutes and is then dyed in the same bath in the customary manner. Uniform and deep penetration dyeings are obtained.

EXAMPLE 21

Well-softened pelts, such as, for example, kid, muskrat, mink or the like, are tanned as follows, after pickling and if necessary cutting thinly: 800% of liquor at 28 to 30° C., 2 g/liter of liquor of a product according to the invention (for example according to Example 3) in 2 portions at an interval of 20 minutes, 2 hours.

Additive: 2 g/litre of liquor of potash alum, 1 g/liter of chrome alum or chromium acetate, 8 to 10 hours running time. The liquor is then brought up to pH 4.0 to 4.2 with sodium acetate in the course of 2 hours and fat liquoring is carried out in the customary manner in the same bath or after the skins have been dripped or centrifuged, by coating with fat liquor.

The skin is very soft and the hair is outstanding in gloss and condition.

EXAMPLES 22 AND 23

Similarly good results are obtained when Examples 17 and 18 are repeated with the reaction products from Examples 1, 2 and 4 to 16.

What is claimed is:

1. A tanning agent comprising a condensation product of acetaldehyde, formaldehyde and formylamino compound in the molar ratio 1: (0.4 to 4) : (0.1 to 3).

2. Tanning Agent according to claim 1 wherein the molar ratio of acetaldehyde : formaldehyde : formylamino compound is 1: (0.5 to 3.1) : (0.2 to 2).

3. Tanning Agent according to claim 1 wherein the molar ratio of acetaldehyde : formaldehyde : formylamino compound is 1: (0.5 to 3) : (0.2 to 2).

4. Tanning Agent according to claim 1 wherein the formylamino compound contains at least one moiety of the formula

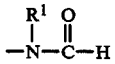

wherein $R^1$ is H or $—CH_2OH$.

5. Tanning Agent according to claim 1 wherein the formylamino compound has the formula

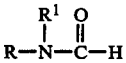

wherein R is H, alkyl having 1 to 8 carbon atoms, alkenyl having 2 to 8 carbon atoms, $—(CH_2)_m—N(R^1)—CHO$ or $-O-(CH_2)_n—O'$; $R^1$ is H or $—CH_2—OH$; m is an integer from 0 to 8; and n is an integer from 1 to 8.

6. Tanning Agent according to claim 1 wherein the formylamino compound is a homopolymer of vinylformamide or a copolymer of vinylformamide and a comonomer selected from the group consisting of acrylic acid, methacrylic acid, olefinically unsaturated sulfonic acid, olefinically unsaturated phosphonic acid, esters of olefinically unsaturated phosphonic acid, olefinically unsaturated quaternary ammonium compounds and vinyl amide.

7. Aqueous solution according to claim 1, wherein the formylamino compound is a homopolymer or copolymer having a molecular weight of about 5,000 to 500,000 and containing structural units of the formula

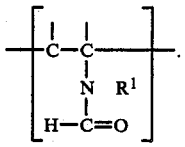

8. Process for the preparation of a tanning agent which comprises reacting, in an aqueous phase, acetaldehyde, formaldehyde and a formylamino compound in a molar ratio of (0.4 to 4) moles formaldehyde and (0.1 to 3) moles formylamino compound per mole of acetaldehyde.

9. Process according to claim 8 wherein the molar ratio of acetaldehyde : formaldehyde : formylamino compound is 1: (0.5 to 3.1) : (0.2 to 2.2).

10. Process according to claim 8 wherein the molar ratio of acetaldehyde : formaldehyde : formylamino compound is 1: (0.5 to 3) : (0.2 to 2).

11. Process according to claim 8 whrein the reaction temperature is from 0 to 140° C.

12. Process according to claim 8 whrein the reaction temperature is from 5 to 130° C.

13. Process according to claim 8 wherein the reaction temperature is from 100 to 140° C.

14. Process according to claim 8 wherein the reaction temperature is from 110 to 130° C.

15. Process according to claim 8 wherein the reaction is carried out under alkaline catalysis.

16. A method of tanning hides, skins and pelts which comprises applying to hides, skins or pelts to be tanned the Tanning agent according to claim 1.

17. A method according to claim 16 wherein as an adjunct to said tanning agent, a second mineral, synthetic or vegetable tanning agent is applied to the hides, skins or pelts.

* * * * *